US005980347A

United States Patent [19]

Udagawa et al.

[11] Patent Number: 5,980,347

[45] Date of Patent: Nov. 9, 1999

[54] PROCESS FOR MANUFACTURING PLASMA DISPLAY PANEL

[75] Inventors: Tadahiko Udagawa; Hideaki Masuko, both of Yokkaichi; Yoshio Tanzawa, Kawasaki, all of Japan

[73] Assignee: JSR Corporation, Tokyo, Japan

[21] Appl. No.: 09/054,507

[22] Filed: Apr. 3, 1998

[30] Foreign Application Priority Data

Jul. 25, 1996 [JP] Japan ..... 8-196304

[51] Int. Cl.[6] ..... H01J 9/00

[52] U.S. Cl. ..... 445/24

[58] Field of Search ..... 445/24; 313/584

[56] References Cited

U.S. PATENT DOCUMENTS 5,757,131 5/1998 Tsuchiya ..... 313/584

5,789,862 8/1998 Makino ..... 313/584

*Primary Examiner*—Kenneth J. Ramsey

*Attorney, Agent, or Firm*—Oblon, Spivak, McClelland, Maier & Neustadt, P.C.

[57] ABSTRACT

Disclosed is a process for manufacturing a plasma display panel comprising a novel forming step in which a very thick dielectric layer can be formed in an efficient manner. The process for manufacturing a plasma display panel comprising a step of transferring a coating material layer formed on a support film to the surface of a glass substrate to which an electrode is secured; and a step of baking the transferred coating material layer to form a dielectric layer on the surface of the glass substrate.

14 Claims, 1 Drawing Sheet

PROCESS FOR MANUFACTURING PLASMA DISPLAY PANEL

BACKGROUND OF THE INVENTION

1. Field of the Invention

This invention relates to a process for manufacturing a plasma display panel, and, particularly, to a process for manufacturing a plasma display panel including a novel step of forming a dielectric layer on a glass substrate.

2. Description of the Background Art

A plasma display in the form of a plate-type fluorescent display has attracted considerable attention in recent years. FIG. 1 is a typical view showing a configuration in section of an A.C. type plasma display panel (hereinafter called "PDP"). In this figure, the symbols 1 and 2 represent glass substrates opposedly positioned and the symbol 3 represents a partition wall. A combination of the glass 1, the glass 2, and the partition wall 3 forms divisional cells. The symbols 4, 5, and 6 represent a bus electrode secured to the glass substrate 1, an address electrode secured to the glass substrate 2, and a fluorescent material supported in the cell respectively. The symbol 7 represents a dielectric layer formed on the surface of the glass substrate 1 so as to cover the bus electrode 4. The symbol 8 represents a protective layer made, for example, of magnesium oxide. The dielectric layer 7 is formed of a sintered glass material with a film thickness, for example, of 20 to 50 $\mu$m.

In order to form the dielectric layer 7, there is a known process in which a paste composition containing glass powder is prepared and applied to the surface of the glass substrate 1 by screen printing, followed by drying to form a coating material layer which is then burned to remove organic substances thereby baking the glass powder.

In this case, the thickness of the coating material layer is required to be 1.3 to 1.5 times that of the dielectric layer 7 to be formed in consideration of loss in film thickness associated with the removal of organic materials in the baking step. For example, in order for the thickness of the dielectric layer 7 to be 20 to 50 $\mu$m, the thickness of the coating material layer must be designed to be about 30 to 70 $\mu$m.

On the other hand, if the paste composition containing the above glass powder is applied by screen printing, a film thickness formed by one application is about 15 to 25 $\mu$m. This requires plural repetitions (for example, two to five times) of application of the paste composition to prepare a coating material layer with the desired thickness.

The problems to be solved by the invention, especially relating to the screen printing method, are as follows:

(1) Operation of plurally repeated applications of a paste composition (multiple printing) is complicated and is inferior in workability. It is also necessary to confirm the dispersion condition of the components for each application of the paste composition. Redispersion treatment is required when an inferior dispersion, e.g. deposition of glass powder, occurs. Therefore, the conventional method in which a dielectric layer is formed through such a complicated application step has a problem in view of efficiency of producing a PDP. This problem is more significant as the display panel increases in size.

(2) In the case of forming the coating material layer by multiple printing utilizing a screen printing method, the film thickness of a dielectric layer formed by baking the coating material layer is not uniform. The tolerance, for example, within ±5% cannot be achieved using this method. This is because it is difficult to uniformly apply the paste composition to the surface of the glass substrate by multiple printing utilizing a screen printing method. The dispersion in the film thickness of the dielectric layer is greater with increased area of application (panel size) and with the number of applications. The dispersion in the film thickness causes dispersion in dielectric properties in the surface of a panel material (the glass substrate provided with the dielectric layer) prepared in the application step using multiple printing. This dispersion in dielectric properties causes display defects (uneven luminance) in the PDP.

(3) In the screen printing method, a small amount of air is trapped in the paste composition passing through a screen and there are cases where this air remains as air bubbles in the coating material layer. When the coating material layer containing an air bubble is baked, pinholes or cracks are produced in the formed dielectric layer. In addition, the (n)th coating tends to be damaged by being squeezed in the step of forming the (n+1)th coating. This causes cracks to occur in the dielectric layer. The insulating properties of the dielectric layer are damaged by the pinholes or cracks whereby the dielectric layer exhibits dielectric properties lower than expected.

(4) In the screen printing method, there are cases where the shape of a screen print mesh is transferred to the surface of the coating material layer. A dielectric layer formed by baking such a coating material layer has a deteriorated surface smoothness.

The present invention has been developed in view of this situation and has an object of providing a process for manufacturing a PDP comprising a novel forming step in which a very thick dielectric layer can be formed in an efficient manner.

Another object of the present invention is to provide a process for manufacturing a PDP comprising a novel forming step in which a dielectric layer required for a large panel can be efficiently formed.

Yet another object of the present invention is to provide a process for manufacturing a PDP comprising a dielectric layer with a highly uniform film thickness.

A further object of the present invention is to provide a process for manufacturing a PDP comprising a reliable dielectric layer having no defects, including pinholes or cracks.

A still further object of the present invention is to provide a process for manufacturing a PDP comprising a dielectric layer possessing excellent surface smoothness.

SUMMARY OF THE INVENTION

According to an aspect of the present invention, there is provided a process for manufacturing a PDP (a plasma display panel) comprising:

- a step of forming a coating material layer on a support film;
- a step of transferring the coating material layer from the support film to the surface of a glass substrate to which an electrode is secured; and
- a step of baking the transferred coating material layer to form a dielectric layer on the surface of the glass substrate.

According to another aspect of the present invention, there is provided a process for manufacturing a PDP comprising:

- a step of coating a support film with a paste composition containing glass powder, a binding resin, and a solvent to form a coating material layer;

a step of transferring the coating material layer formed on the support film to the surface of the glass substrate to which an electrode is secured; and a step of baking the transferred coating material layer to form a dielectric layer on the surface of the glass substrate.

In preferred embodiments of a process for manufacturing a PDP in the present invention:

the paste composition is applied using a roll coater to form the coating material layer on the support film;

the thickness of the coating material layer is 10 to 200 $\mu$m; and the glass powder contained in the coating material layer is composed of a mixture of 60 to 90% by weight of zinc oxide, 5 to 20% by weight of boron oxide, and 5 to 20% by weight of silicon oxide.

Other and further objects, features and advantages of the present invention will appear more fully from the following description.

BRIEF DESCRIPTION OF THE DRAWINGS

In the accompanying drawing, there is shown an illustrative embodiment of the invention from which these other objectives, novel features, and advantages will be readily apparent.

In the drawing.

DETAILED DESCRIPTION OF THE INVENTION AND PREFERRED EMBODIMENTS

Figure 1:
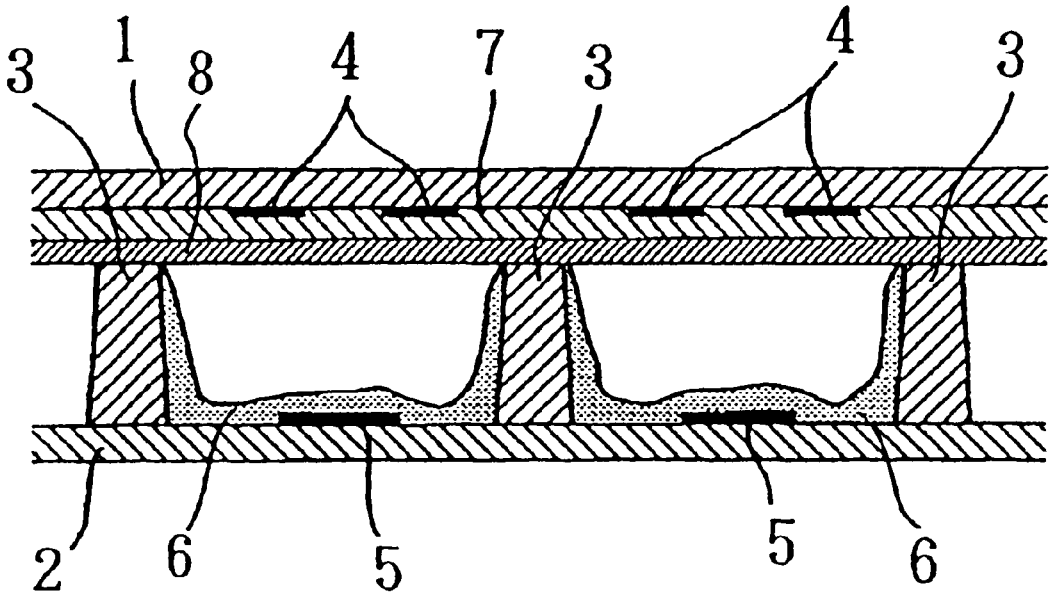
FIG. 1 is a typical view showing the configuration in section of an A.C. type plasma display panel.

The present invention will now be explained in detail.

In the manufacturing process of the present invention, a coating material layer which will be converted to a dielectric layer by baking is formed by applying a paste composition containing glass powder not directly on a rigid glass substrate but on a flexible support film. An application method using a roll coater can be used to apply the paste composition, whereby a coating material layer with a very thick film and a highly uniform film thickness (for example, 100 $\mu$m±5 $\mu$m) can be formed on the support film. In a very simple method whereby the coating material layer formed in this manner is transferred in bulk to the surface of the glass substrate, the coating material layer can be formed with certainty on the glass substrate. Therefore, in the manufacturing process of the present invention, an improvement (high efficiency) in the process of manufacturing the dielectric layer and an improvement in the quality of the dielectric layer (development of stable dielectric properties)to be formed can be made.

The manufacturing process of the present invention is hereinafter described in detail. In the manufacturing process of the present invention comprising a step of transferring the coating material layer using a transfer film and a step of baking the coating material layer, a dielectric layer is formed on the surface of a glass substrate.

(1) Transfer Film:

A transfer film used in the manufacturing process of the present invention is provided with a support film and a coating material layer formed on the support film.

The support film constituting the transfer film is desirably a resin film having flexibility as well as heat resistance and solvent resistance. Since the support film is flexible, the paste composition can be applied using a roll coater and the coating material layer can be stored as a wrapped roll which can be supplied as is. Examples of the resin used for forming the support film include polyethylene terephthalate, polyester, polyethylene, polypropylene, polystyrene, polyimide, polyvinyl alcohol, polyvinyl chloride, fluorine-containing resins such as polyfluoroethylene and the like, nylon, and cellulose. The thickness of the support film is, for example, from 20 to 100 $\mu$m.

The coating material layer constituting the transfer film can be formed by applying a paste composition containing, as essential components glass powder, a binding resin, and a solvent to the support film and by drying the resulting coating to remove a part or all of the solvent.

Examples of the glass powder as the essential component of the paste composition include glass powders formed from (i) a molten mixture of zinc oxide, boron oxide, and silicon oxide ($ZnO—B_2O_3—SiO_2$ type); (ii) a molten mixture of lead oxide, boron oxide, and silicon oxide ($PbO—B_2O_3—SiO_2$ type); (iii) a molten mixture of lead oxide, boron oxide, silicon oxide, and aluminum oxide ($PbO—B_2O_3—SiO_2—Al_2O_3$ type); and (iv) a molten mixture of lead oxide, zinc oxide, boron oxide, and silicon oxide ($PbO—ZnO—B_2O_3—SiO_2$ type). A paste composition containing zinc oxide as a major component, specifically, the molten mixture of zinc oxide, boron oxide, and silicon oxide among these molten mixtures is preferable because it can be baked at a relatively low temperature (600° C. or less).

There are no limitations to the binding resin, which is an essential component of the paste composition, to the extent that it has adequate adhesion to bind glass powder and can be completely oxidized and removed in a process for baking (at 400 to 600° C.) the coating material layer. Examples of the binding resin include acrylate-type resins such as polymethyl methacrylate, polybutyl methacrylate, and the like; and cellulose-type resins such as ethyl cellulose, nitrocellulose, and the like.

As the solvent which is an essential component for the paste composition, solvents which can provide the paste composition with an adequate viscosity (for example, 500 to 10,000 cp) and can be easily removed by drying are preferable. For example, turpentine oil, cellosolve (ethyl cellosolve), methyl cellosolve, terpineol, butylcarbitol acetate, butylcarbitol, benzyl alcohol, methyl lactate, ethyl lactate, propylene glycol, monomethylene ether, or the like may be preferably Used as the solvent.

The paste composition may contain, besides the above essential components, various additives including a dispersant, adhesion-donating agent, plasticizer, surface tension controlling agent, stabilizing agent, anti-foaming agent, and the like as optional components.

Given as a preferable example of the paste composition is a composition comprising 100% by weight of a glass powder which is a mixture of zinc oxide (60–90 wt %), boron oxide (5–20 wt %), and silicon oxide (5–20 wt %), or a mixture of lead oxide (50–80 wt %), boron oxide (5–20 wt %), and silicon oxide (5–30 wt %), 2 to 10% by weight of polymethyl methacrylate (a binding resin), and 10 to 50% by weight of terpineol (a solvent) as essential components.

A method for applying the paste composition to the surface of the support film is required to efficiently form a very thick coating with a highly uniform film thickness (e.g. 30 $\mu$m or more). Particularly preferable examples of the method include application methods using a roll coater, doctor blade, curtain coater, wire coater, or the like.

It is desirable that the surface of the support film to be coated with the paste composition be provided with a mold-releasing treatment. This allows the support film to be easily peeled off in a transfer step described below.

The resulting coating is dried, for example, at 50 to 150° C. for about 0.5 to 30 minutes. The proportion (the content in the coating material layer) of the residual solvent after being dried is generally 10% by weight or less.

The thickness of the coating material layer formed in the above manner is, for example, from 10 to 200 μm and preferably from 30 to 100 μm though this depends on the content of glass powder and on the types and sizes of panel. If the thickness is less than 10 μm, the resulting dielectric layer is too thin whereby there is the case where desired dielectric properties cannot be ensured. Generally, if the thickness is in a range from 30 to 100 μm, a film thickness sufficient for a large panel can be ensured.

In addition, the transfer film may be provided with a protective film layer formed on the surface of the coating material layer. As examples of such a protective layer, a polyethylene film, polyvinyl alcohol type film, or the like can be given.

(2) Step of Transferring the Coating Material Layer:

The manufacturing process of the present invention is characterized in that, using the transfer film produced in the aforementioned manner, the coating material layer constituting the transfer film is transferred to the surface of the glass substrate to which an electrode is secured.

The transfer step is illustrated by the following example: The protective film of the transfer film used is peeled off as required. The transfer film is overlaid on the surface of the glass substrate (to which an electrode is secured) in a manner so that the surface of the coating material layer is in contact with the surface of the glass substrate. After the transfer film is pressed under heat using a heated roller, the support film is peeled and removed from the coating material layer. This treatment allows the coating material layer to be transferred to and to adhere to the surface of the glass substrate. In this case, the transfer conditions are such that, for example, the surface temperature of the heated roller is from 80 to 100° C., the roll pressure by the heated roller is from 1 to 5 kg/cm$^2$, and the travel speed of the heated roller is from 0.5 to 10.0 m/minute. The glass substrate may be preheated. The preheated temperature may be, for example, from 40 to 60° C.

(3) Step of Baking the Coating Material Layer:

The coating material layer transferred to the surface of the glass substrate is baked. Specifically, the glass substrate on which the coating material layer is formed is placed under a high temperature atmosphere whereby organic substances (e.g. a binding resin, residual solvent, and various additives) contained in the coating material layer are removed by decomposition or the like and the glass powder which is an inorganic substance is allowed to melt and thereby to complete baking. A dielectric layer made of a glass sintered body is thus formed on the glass substrate. In this case, the baking temperature, though it differs depending on structural components of the coating material layer, is, for example, 400 to 600° C.

EXAMPLES

The present invention will be explained in more detail by way of examples, which are not intended to be limiting of the present invention. In the examples hereinafter "parts by weight" is simply described as "parts".

Example 1

(Step of Manufacturing a Transfer Film)

100 parts of ZnO—$B_2O_3$—$SiO_2$ type glass frit composed of zinc oxide (80 wt %), boron oxide (10 wt %), and silicon oxide (10 wt %) as glass powder, 30 parts of a copolymer (a binding resin, weight average molecular weight: 100,000) of methacrylic acid (10 wt %) and methyl methacrylate (90 wt %), 30 parts of ethylene glycol diacrylate (an adhesion-donating agent), and 60 parts of methyl cellosolve (a solvent) were kneaded to prepare a paste composition with a viscosity of 5,000 cp.

Next, the prepared paste composition was applied to the surface of a support film (200 mm wide, 30 m long, 38 μm thick) made of a polyethylene terephthalate (PET) film, which had been subjected to a mold-releasing treatment in advance, using a roll coater to form a coating. The formed coating was dried at 110° C. for two minutes to completely remove the solvent and thereby to manufacture a transfer film in which a coating material layer with a thickness of 50 μm was formed on the support film.

(Step of Transferring the Coating Material Layer)

The transfer film was overlaid on the surface of the glass substrate (to which a bus electrode was secured) for a 6 inch panel in a manner so that the surface of the coating material layer was in contact with the surface of the glass substrate. The transfer film was pressed under heat using a heated roller. In this case, the pressing conditions are such, for example, that the surface temperature of the heat roller was 120° C. or greater, the roll pressure was 4 kg/cm$^2$, and the travel speed of the heat roller was 1 m/minute. After completion of the heat pressing, the support film was peeled away and removed from the coating material layer. This treatment allowed the coating material layer to be transferred to and to adhere to the surface of the glass substrate. The thickness of the coating material layer was in a range from 50 μm±2 μm by actual measurement. (Step of baking the coating material layer)

The transferred coating material layer was heated from room temperature to 450° C. at a temperature increase rate of 10° C./minute and baked at 450° C. for 30 minutes to form a dielectric layer made of a glass sintered body on the surface of the glass substrate. The film thickness of the dielectric layer was within the range of 35 μm±1.5 μm by actual measurement with the film thickness having excellent uniformity.

(Evaluation of Performance of the Dielectric Layer)

In this manner, five panel materials composed of a glass substrate provided with a dielectric layer were manufactured. The section and surface conditions of the resulting dielectric layers were observed using a scanning electron microscope. As a result, film defects, e.g. pinholes or cracks were not observed in the dielectric layers formed in all panel materials.

Example 2

(1) Preparation of a Glass Paste Composition:

100 parts of a PbO—$B_2O_3$—$SiO_2$ type glass frit (softening point: 500° C.) composed of lead oxide (70 wt %), boron oxide (10 wt %), and siliconoxide (20 wt %) as glasspowder, 20 parts of polybutyl methacrylate as a binding resin (weight average molecular weight: 50,000), 1 part of polypropylene glycol (weight average molecular weight: 400) as an additive, and 20 parts of propylene glycol monomethyl ether as a solvent were kneaded using a dispersing machine to prepare a composition according to the present invention with a viscosity of 4,000 cp.

(2) Manufacture of a Transfer Film:

Next, the composition of the present invention prepared in (1) above was applied to the surface of a support film (200 mm wide, 30 m long, 38 μm thick) made of polyethylene terephthalate (PET), which had been subjected to a mold-releasing treatment in advance, using a blade coater. The formed coating was dried at 100° C. for five minutes to remove the solvent and thereby to manufacture a transfer film in which a coating material layer with a thickness of 50 μm was formed on the support film.

This transfer film was flexible and could be rolled up easily. Also, even if the transfer film was bent, no cracks (flexure crack) occurred on the surface of the coating material layer, indicating that the coating material layer had improved flexibility.

(3) Transfer of the Coating Material Layer:

The transfer film prepared in (2) above was overlaid on the surface of the glass substrate for a 6 inch panel in a manner so that the surface of the coating material layer contacted the surface of the glass substrate. The transfer film was pressed under heat using a heat roller. In this case, the pressing condition was such that, for example, the surface temperature of the heated roller was 110° C., the roll pressure was 3 kg/cm$^2$, and the travel speed of the heated roller was 1 m/minute.

After completion of the heat pressing, the support film was peeled away and removed from the coating material layer secured (applied under heat) to the surface of the glass substrate to complete the transfer of the coating material layer.

The coating material layer had sufficiently large film strength without cohesive failure when the support film was peeled off in the transfer step. The transferred coating material layer adhered strongly to the surface of the glass substrate.

(4) Baking of the Coating Material Layer (Formation of a Dielectric Layer)

The glass substrate on which the coating material layer was transferred and formed was placed in a furnace, in which the temperature was raised from room temperature to 550° C. at a rate of 10° C./minute, and baked at 550° C. for 30 minutes to form a colorless dielectric layer made of a glass sintered body on the surface of the glass substrate.

The film thickness (average film thickness and a tolerance) of the dielectric layer was in a range of 30 μm ±0.4 μm by actual measurement with the film thickness having excellent uniformity.

Comparative Example

A paste composition having the same ingredients as in Example 1 was prepared and applied to a glass substrate (the same substrate as used in the Examples) by multiple printing utilizing a screen printing method to form a coating material layer. Here, the dried film thickness from one application was about 15 to 17 μm and the number of applications was three. The film thickness of the resulting coating material layer was in a range of 50 μm±5 μm by measurement. The resulting coating material layer was baked in the same manner as in the Examples to form a dielectric layer on the surface of the glass substrate. The film thickness of the dielectric layer was in a range of 35 μm±4 μm by actual measurement with the film thickness showing lack of uniformity. In this manner, five panel materials made of a glass substrate provided with a dielectric layer were manufactured. The section and surface conditions of the resulting dielectric layers were observed using a scanning electron microscope. As a result, film defects, e.g. pinholes or cracks, were observed in 60% (three panels) of the panel materials.

According to the process of the present invention, even a very thick dielectric layer can be efficiently formed by a simple process comprising a step of transferring a coating material layer, and the process of manufacturing the dielectric layer can be improved, thereby improving the production efficiency of the PDP.

In the process of the present invention, a dielectric layer with a large thickness can also be formed with the uniformity (tolerance of film thickness within 5%) of the film thickness being maintained, and even a dielectric layer required for a large panel can be formed in an efficient manner.

The process of the present invention is also featured in that a dielectric layer which has a highly uniform film thickness and surface smoothness and has no defects including pinholes or cracks can be formed. Therefore, stable dielectric properties can be exhibited by virtue of such a highly reliable dielectric layer and, as a result, a PDP manufactured by the process of the present invention never imparts a problem of display defects such as uneven luminance.

What is claimed is:

1. A process for manufacturing a plasma display panel comprising:

a step of forming a coating material layer on a support film;

a step of transferring the coating material layer from the support film to the surface of a glass substrate; and a step of baking the transferred coating material layer to form a dielectric layer on the surface of the glass substrate.

2. The process for manufacturing a plasma display panel according to claim 1, wherein the coating material is a paste composition comprising glass powder, abinding resin, and a solvent.

3. The process for manufacturing a plasma display panel according to claim 2, wherein the glass powder is a mixture of 60 to 90% by weight of zinc oxide, 5 to 20% by weight of boron oxide, and 5 to 20% by weight of silicon oxide.

4. The process for manufacturing a plasma display panel according to claim 2, wherein the glass powder is a mixture of 50 to 80% by weight of lead oxide, 5 to 20% by weight of boron oxide, and 5 to 30% by weight of silicon oxide.

5. The process for manufacturing a plasma display panel according to claim 2, wherein the binding resin is selected from acrylate-type resins and cellulose-type resins.

6. The process for manufacturing a plasma display panel according to claim 2, wherein the binding resin is selected from the group consisting of polymethyl methacrylate, polybutyl methacrylate, ethyl cellulose, and nitrocellulose.

7. The process for manufacturing a plasma display panel according to claim 2, wherein the solvent is selected from the group consisting of turpentine oil, ethyl cellosolve, methyl cellosolve, terpineol, butylcarbitol acetate, butylcarbitol, benzyl alcohol, methyl lactate, and ethyl lactate.

8. The process for manufacturing a plasma display panel according to claim 1, wherein the coating material layer has a thickness from 10 to 200 μm.

9. The process for manufacturing a plasma display panel according to claim 1, wherein the support film is made of a resin selected from the group consisting of polyethylene terephthalate, polyester, polyethylene, polypropylene, polystyrene, polyimide, polyvinyl alcohol, polyvinyl chloride, polyfluoroethylene, nylon, and cellulose.

10. The process for manufacturing a plasma display panel according to claim 1, wherein the step of transferring the coating material layer from the support film to the surface of a glass substrate comprises overlaying the transfer film onto the surface of the glass substrate in a manner so that the surface of the coating material layer is in contact with the surface of the glass substrate, pressing the transfer film under heat using a heated roller, and removing the support film from the coating material layer by peeling.

11. The process for manufacturing a plasma display panel according to claim 10, wherein the transferring operation is carried out under the conditions of the surface temperature of the heated roller from 80 to 100° C., the roll pressure by the heated roller from 1 to 5 kg/cm$^2$, and the travel speed of the heated roller from 0.5 to 10.0 m/minute.

12. The process for manufacturing a plasma display panel according to claim 1, wherein the baking is carried out at a sufficiently high temperature to decompose organic substances contained in the coating material.

13. The process for manufacturing a plasma display panel according to claim 1, wherein the baking temperature is from 400 to 600° C.

14. A process for manufacturing a plasma display panel comprising:

a step of coating a support film with a paste composition comprising a glass powder, a binding resin, and a solvent to form a coating material layer;

a step of transferring the coating material layer formed on the support film to the surface of the glass substrate; and a step of baking the transferred coating material layer to form a dielectric layer on the surface of the glass substrate.

* * * * *

UNITED STATES PATENT AND TRADEMARK OFFICE

CERTIFICATE OF CORRECTION

PATENT NO. : 5,980,347

DATED : November 9, 1999

INVENTOR(S): Tadahiko UDAGAWA, et al

It is certified that an error appears in the above-identified patent and that said Letters Patent is hereby corrected as shown below:

On the title page, item [30], the Foreign Application Priority Data should be deleted.

Signed and Sealed this

Twenty-fifth Day of July, 2000

*Attest:*

*Attesting Officer*

Q. TODD DICKINSON

*Director of Patents and Trademarks*